US005379714A

United States Patent [19]

Lewis et al.

[11] Patent Number: 5,379,714

[45] Date of Patent: Jan. 10, 1995

[54] UNDERWATER VEHICLE

[75] Inventors: James E. Lewis, Johnson City; Jon R. Johnson, Jonesborough, both of Tenn.

[73] Assignee: Under Sea Travel, Inc., Johnson City, Tenn.

[21] Appl. No.: 134,974

[22] Filed: Oct. 12, 1993

[51] Int. Cl.[6] ..... B63C 11/46

[52] U.S. Cl. ..... 114/315; 440/6

[58] Field of Search ..... 440/6, 7; 114/312, 315; D12/308

[56] References Cited

U.S. PATENT DOCUMENTS

| | | | |
|---|---|---|---|
| D. 195,798 | 7/1963 | Scoma . | |
| D. 220,926 | 6/1971 | Peroni . | |
| D. 304,923 | 12/1989 | Pado . | |
| D. 323,808 | 2/1992 | DeSantis | D12/308 |
| 3,014,448 | 12/1961 | Fogarty et al. | 114/315 |
| 3,034,467 | 5/1962 | Pestronk | 114/315 |
| 3,442,240 | 5/1969 | Wild et al. | 114/315 |
| 3,685,480 | 8/1972 | Peroni | 114/315 |
| 3,757,721 | 9/1973 | Ohishi | 114/315 |
| 3,789,788 | 2/1974 | Peroni | 114/315 |
| 3,890,920 | 6/1975 | Buelk | 114/315 |
| 4,467,742 | 8/1984 | Duboy | 114/315 |
| 4,864,959 | 9/1989 | Takamizawa | 114/315 |
| 4,996,938 | 3/1991 | Cameron et al. | 114/315 |
| 5,105,753 | 4/1992 | Chih | 114/315 |
| 5,303,666 | 4/1994 | DeSantis et al. | 440/6 |

FOREIGN PATENT DOCUMENTS

| | | |
|---|---|---|
| 23714/56 | 6/1957 | Australia . |
| 1578922 | 8/1969 | France . |

*Primary Examiner*—Jesus D. Sotelo

*Attorney, Agent, or Firm*—Luedeka, Neely & Graham

[57] ABSTRACT

An aquatic vehicle particularly suited for underwater transport of swimmers and divers comprises the assembly of a cylindrical body having a detachable nosecone and a shrouded propeller. The nosecone supports an externally open ballast receptacle. The propeller shroud is secured to the aft edge extremities of aft end stabilizing and directional alignment fins. Propeller supply water is drawn through aft end apertures through the cylindrical body wall located between the fins and over the electric drive motor housing for motor cooling. Front and canard fins further contribute to the directionality and ease of steering. Electric power is provided by sealed cell lead/acid batteries having a gelatinous electrolyte. Additional battery design features preclude sea water leakage damage and gaseous combustion. Battery charge state is continuously reported to the user by a light emitting diode display and a supporting liquid presence sensor interrupts the power circuit operation when the vehicle is not in buoyant operation as a safety precaution against propeller inflicted injuries when the vehicle is out of the water.

27 Claims, 4 Drawing Sheets

UNDERWATER VEHICLE

BACKGROUND OF THE INVENTION

1. Field of the Invention

The present invention relates to electrically powered aquatic vehicles of the type particularly suited for pulling swimmers and divers to underwater depths.

2. Description of the Prior Art

As an electromechanical propulsion system, vehicles or vessels of the present type are conceptively simple as comprising only a small body shell for housing a d.c. motor, a direct drive propeller, a battery for energizing the motor, a motor control switch and a user's grasp handle. However, due to the hostile underwater operating environment, conditions for safety and reliability quickly complicate the design choices.

Wet cell lead/acid batteries provide the least expansive and conveniently rechargeable energy source but are simultaneously the source of combustible hydrogen gas. If generated, the gas must be purged from the system to avoid the risk of explosion.

Brush/commutator d.c. motors provide the most economical torque and operational efficiency for the service but also offer an exposed arc ignition source for any combustible gas mixture present.

Buoyancy demands for such a vehicle quickly change by the user's needs, concerns, safety and whim. Preferably, the user would choose to rapidly select between reversible options of positive, negative or neutral buoyancy. There are times when the user would prefer that his personal vehicle simply remain suspended when released.

Other times, he would have the vehicle rise to the surface when released. A negatively buoyant vehicle will descend by gravity to the first support surface.

Most such vehicles are steered by physical pointing which requires some form of twisting or torque couple, consequently, placement of the manual handgrip position relative to buoyancy and weight distribution is critical. Instability and excessive coupling lead to user fatigue.

Finally, when a prior art vehicle is out of the water with charge remaining in the battery, the propeller becomes a hazardous source of personal injury.

It is, therefore, an object of the present invention to teach the construction of a personal underwater tow vehicle that is substantially free of gas explosion hazards.

Another object of the present invention is to provide a personal underwater tow vehicle that will not leak battery acid.

Another object of the present invention is to provide a personal underwater tow vehicle having a continuously reported state of battery charge.

Another object of the present invention is to provide a personal underwater tow vehicle that is easily and comfortably steered.

Another object of the present invention is to provide a personal underwater tow vehicle in which the propeller power circuit is rendered inoperative when the vehicle is out of water.

A still further object of the present invention is to facilitate immediate and in-use buoyancy adjustments.

SUMMARY

Regarding the foregoing and other objects of the invention to be subsequently described or made apparent, the present invention includes a cylindrical main body member having a detachable nose cone. Within the body cylinder is an isolated battery compartment having a battery anchoring shelf secured therein. Another isolated compartment in the main body cylinder houses the predominance of unit wiring including the motor case penetration points.

Set within an aft section of the main body cylinder is an end mounted electric propulsion motor having a propeller connected directly to the motor shaft by shear pin. Large apertures penetrate the body cylinder wall within the aft section to pass water over the motor housing for cooling purposes in route to the propeller.

Directional stabilizing fins are secured to the main body cylinder in the motor area between the cooling water apertures for radial emanation. A circular shroud secured to the outer, aft extremities of the aft fins surrounds the propeller sweep circle and protects a user from engagement with the propeller. Canard fins ahead of the handgrip plane further add to the directional stability and ease of control and steering.

Electrical energy to drive the propulsion motor is obtained from one or more lead/acid batteries having cells activated by immobile, gelatinous electrolyte.

Motor operation is guarded by a liquid sensor which disables the motor drive circuit when the vehicle is out of the water.

A cascaded, voltage sensitive LED array visible to a submerged swimmer at a user's vantage position qualitatively reports the current state of battery charge.

The nose cone includes an externally accessible compartment for the convenience of additional ballast. The vehicle may be internally trimmed to a slightly positive buoyancy. Addition of a standard divers light to the nosecone compartment should neutralize the buoyancy or make it slightly negative.

BRIEF DESCRIPTION OF THE DRAWINGS

Relative to the drawings wherein like reference characters designate like or similar elements throughout the several drawing figures.

DESCRIPTION OF THE PREFERRED EMBODIMENT

Figure 1:
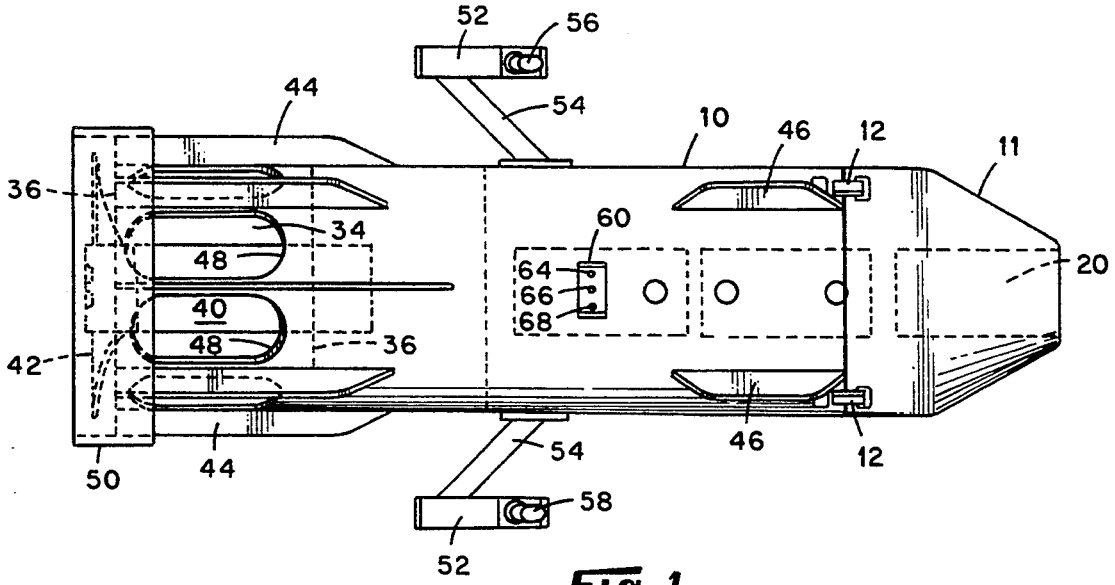
FIG. 1 is a plan view of the present invention.
Figure 2:
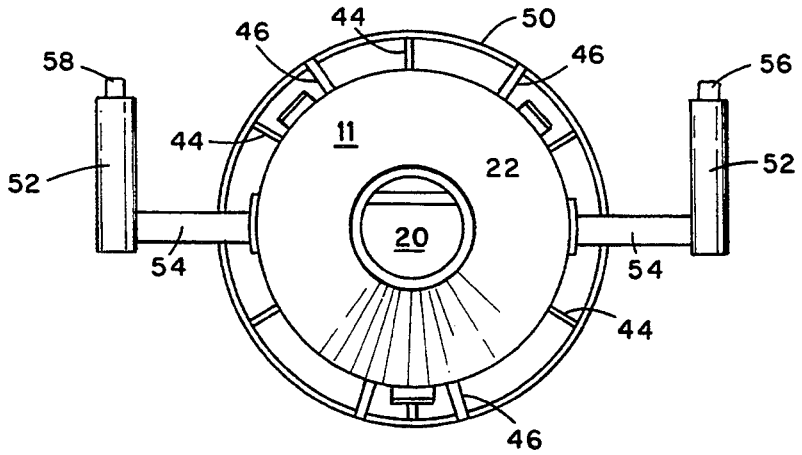
FIG. 2 is a front and elevation of the present invention.
Figure 3:
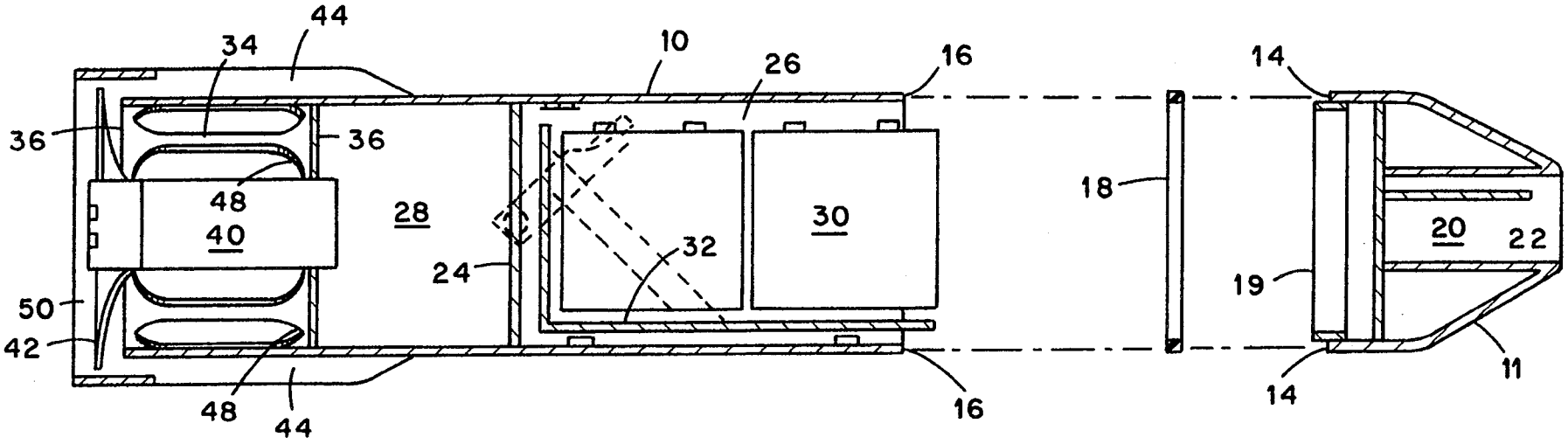
FIG. 3 is a sectioned side elevation of the invention.

In reference to FIGS. 1 and 3 of the drawings, the basic body frame of the invention, for example, is an 8 to 9 inch outside diameter, cylindrical tube 10 of high density polyvinyl chloride material having a length of about 25 inches and a tube wall thickness of about $\frac{1}{4}$ inches. Of course, other materials such as aluminum, fiberglass composites and other cast or extruded polymers may also be used.

This cylindrical tube body 10 is closed at the fore end by a nosecone 11 of molded fiberglass composite. Camclips 12 draw the nosecone compression edge 14 into the tube body compression edge 16 to compress gasket 18 in the annular space between the compression edges and the center guide lip 19. The guide lip 19 may be an integrally sealed surface of either the nosecone 11 or the body 10.

Nosecone 11 may also be provided with a ballast compartment 20 that is open to the exterior environment. A standard partition or shelf 22 across the compartment 20 provides a convenient anchor surface for the belt-clip of a personal flash light not shown. If the vessel is trimmed to a slight positive buoyancy of 0.5 pound to 1 pound with an empty ballast compartment 20, conveniently available equipment pieces such as the personal flashlight may be stored in the compartment to negatively alter the buoyancy trim.

A partition 24 isolates the battery compartment 26 from the buoyancy compartment 20. One or more batteries 30 are secured in place by a removable battery support frame 32.

Near the aft end 36 of the tube body 10 is a motor compartment 34 which is open to the environment at the aft end. A motor mounting partition 36 seals the aft end of the buoyancy compartment 28 from the flooded motor compartment 34.

The d.c. electric motor 40 preferably is of the brush-/commutator type such as is manufactured by Johnson Fishing, Inc. of Mamkato, Minn. These motors are constructed with redundant shaft seals for a permanently sealed housing interior. Speed control windings respective to two operating speeds are located within the sealed housing. The external case is aluminum and steel and is epoxy bonded into a penetration aperture of the fiberglass compartment partition 36.

A propeller 42 is secured directly to the stainless steel motor armature shaft projection by traditional means such as a shear pin. High torque turbo design type propellers cast from polymers such as high impact nylon are preferred.

Externally of the flooded motor compartment 34 are several aft end directional alignment fins 44. Through the wall of tube body 10 between the aft fins 44 are thrust flow apertures 48. A ring shroud 50 surrounds the propeller circle and is secured to each of the aft fins 44 at the radially outer edge thereof. It should be appreciated that this structural and design arrangement of the fins 44, flow apertures 48 and propeller shroud 50 accomplishes several obvious and unobvious objectives.

Obviously, the fins 44 tend to hold the vessel on a straight course through the water and the shroud 50 tends to protect the user from the driven sweep of the propeller tips. Attachment of the shroud 50 to the fin 44 outer edges also strengthens and reinforces the unit assembly.

Less obvious is the creation of a fluid capture area in front of the shroud 50 adjacent the apertures 49 which tends to drive a water flow radially inward through the apertures 48, against the outer surface of the motor 40 housing, and along the motor compartment 34 thrust flow annulus between the motor 40 housing and the inner surface of the body tube wall 10 thereby cooling the motor by direct, high heat transfer rate, conduction. At the end of the motor cooling channel, such cooling water is drawn into the propeller sweep to be accelerated into propulsion thrust.

Canard fins 46 cooperate with the aft fins 44 to further stabilize a course setting thereby reducing operator effort and fatigue. User attachment grips 52 are secured by brackets 54 to the body tube 10 between the aft fins 44 and the canards 46. The optimum grip 52 location along the tube body 10 length is dependent upon many variables, particularly the battery weight and distribution. Generally, however, the grip location will be approximately 10% to 20% aft of the longitudinal center point.

As previously described, the motor 40 has two fixed speeds respectively determined by induction windings located within the sealed motor housing. Speed selection is accomplished by operation of either toggle switch 56 or 58: e.g. switch 56 for the greater speed or switch 58 for the lesser speed. These sealed switches 56 and 58 are in respective electrical circuits between the batteries 30 and the motor 40 speed windings as illustrated by the electrical schematic of FIG. 4. Selection of the greater speed enables the diver a more expeditious transport of distance or depth but also consumes more battery energy and to many, an uncomfortable ride. The lesser speed is less tiring, allows a greater transport distance and for touring, more enjoyable.

Although the batteries 30 are generically characterized as lead/acid wet cell devices, a preferred embodiment of the invention relies upon a proprietary cell such as manufactured by the Elpower Corporation of Santa Ana, Calif. which is a division of Eldon Industries, Inc. also of Santa Ana, Calif. This device, having the trademark identity of "Technacell", has several unusual characteristics which, singularly and collectively, contribute to the unique combination of this invention. One such characteristic is thixotropically immobilized gelatinous electrolyte which permits the battery to be used in any position without concern for cell leakage. A network of porous paths is formed through the gelatinous electrolyte allowing oxygen emitted at the positive plates to travel to the negative plates for recombination with the lead and sulfuric acid to form water but in small and highly localized areas due to an electrolyte formulation that contains approximately 20% more $H_2SO_4$ than is necessary to complete the basic electrolyte chemical reactions of:

$$O_2+2Pb \rightarrow 2PbO$$

$$PbO+H_2SO_4 \rightarrow PbSO_4+H_2O$$

which drives the battery charge/discharge mechanism of:

| Charged Condition | | | | | | Discharcle Condition | | | | |
|---|---|---|---|---|---|---|---|---|---|---|
| Pos. Electrode | | Neg. Electrode | | Electrolyte | → | Pos. Electrode | | Neg. Electrode | | Electrolyte |
| $Pb\ O_2$ | + | Pb | + | $2H_2SO_4$ | ← | $Pb\ SO_4$ | + | $Pb\ SO_4$ | + | $2H_2O$ |

Additionally, the Technacell battery incorporates negative plates with more capacity than the positive plates so that oxygen is released from the positive plate before hydrogen is formed on the negative. The oxygen then travels through the porous electrolyte gel to the negative plate for water reformation before release of the associated hydrogen as a free gas.

As a precaution, however, the Technicell battery includes a self sealing gas relief valve in an otherwise sealed cell enclosure.

Another source of suitable, sealed cell, lead-acid batteries corresponding to the foregoing description is the Power-Sonic Corporation of Redwood City, Calif.

To monitor the battery 30 charge state, a Light Emitting Diode instrument 62 is secured in a sealed instrument panel 60 between the two user grips 52. With reference to the FIG. 4 electrical schematic, the battery charge monitor 62 comprises three parallel subcircuits, each servicing a respective Light Emitting Diode 64, 66 and 68. At full charge, all three LEDs are illuminated. As the charge declines to a voltage below 10.5 volts, for example, LED 68 will cease conducting. Further charge dimunition, below 9.8 volts, for example, will switch off the mid-range LED 66. Low range LED 64 may be trimmed to switch off at 8.8 volts for example which is somewhat less than a full discharge. However, by virtue of the notice that all LEDs are extinguished, the user knows he has no more than a predetermined use time or distance available to him.

Figure 4:
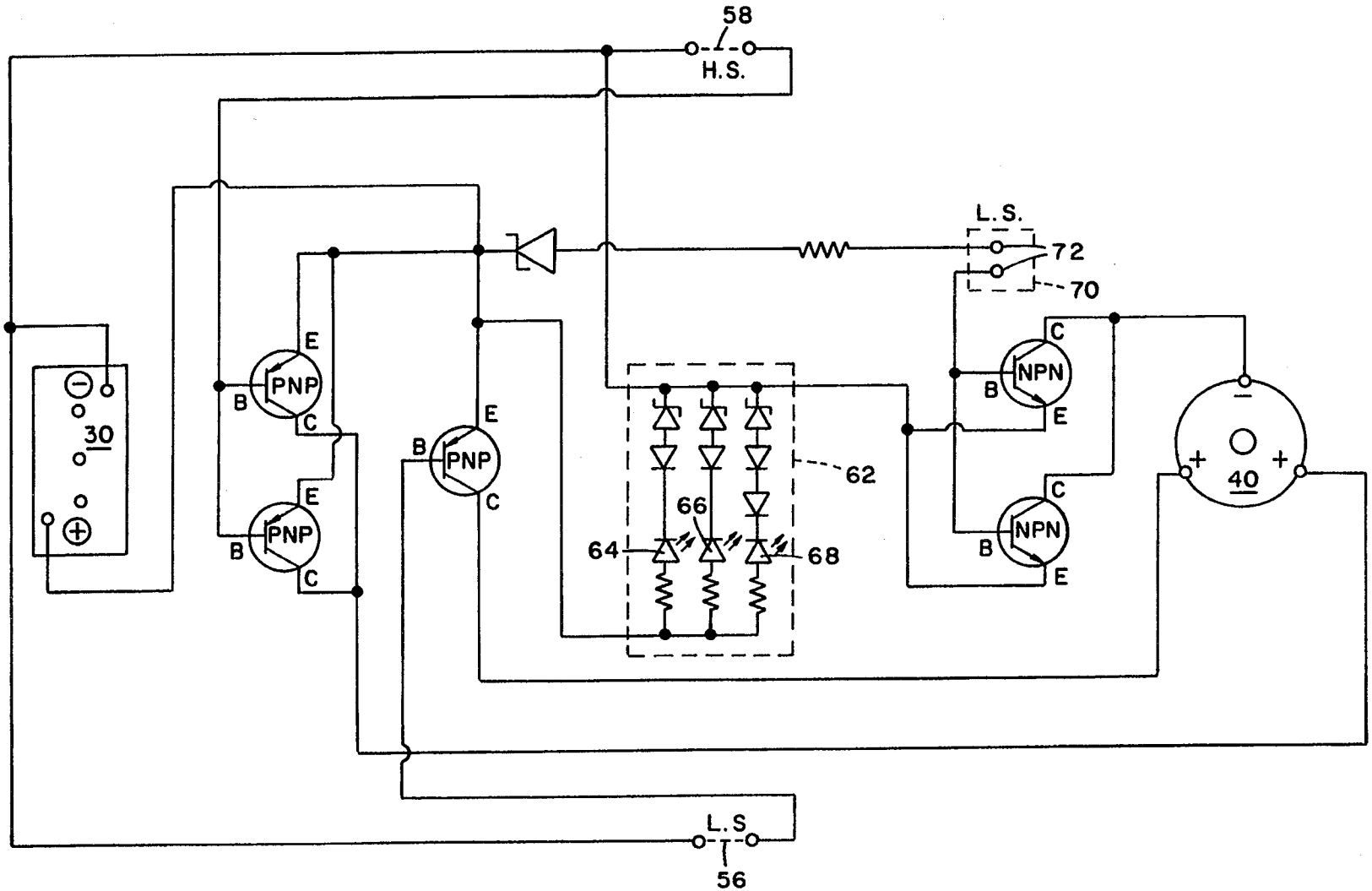
FIG. 4 is an electric circuit diagram descriptive of a preferred embodiment of the invention.

With continued reference to the FIG. 4 schematic, attention is directed to the Liquid Sensor 70 having open electrodes 72. These electrodes are sealed through the lower or bottom elements of the body 10 tube wall so that normal floatation of the vehicle will emerse the electrodes 72 and initiate a limited current flow through the supporting water across the opening between the electrodes. Such conduction will trigger continuity across the C-E terminals of NPN transistors thereby completing the motor 40 power circuit. This Liquid Sensor 70 is a safety device to encumber operation of the motor 40 and propeller 42 from accidental or unintended rotation when the vehicle is out of the water with a charged battery 30.

Figure 5:
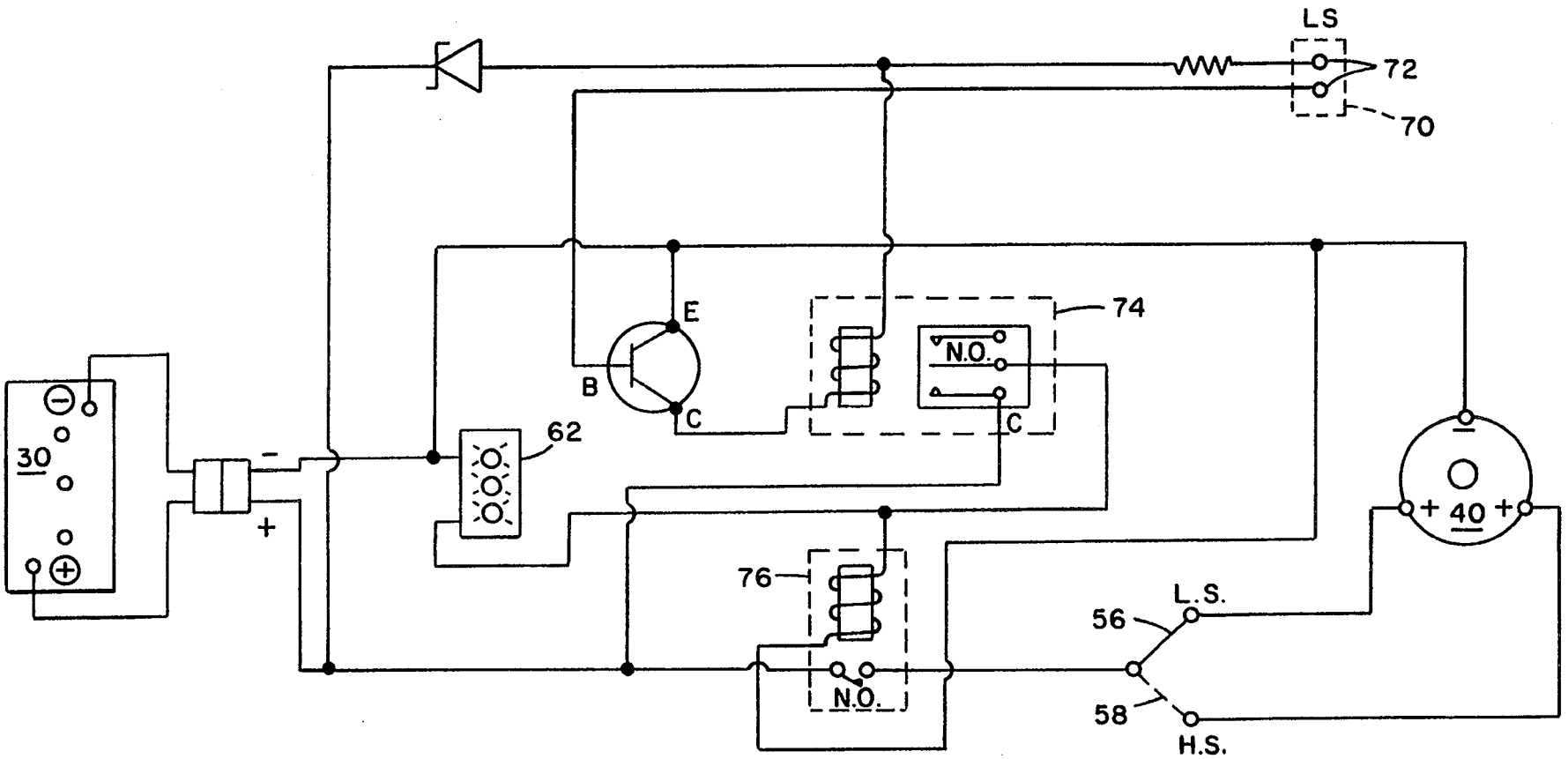
FIG. 5 is an alternative electric circuit diagram suitable for practice of the present invention.

The FIG. 5 circuit diagram is substantially equivalent to that of FIG. 4 but relies upon sealed switching relays 74 and 76 to complete the power circuit to motor 40.

The data of Table 1 represents a test of the power depletion rate for the invention whereby manned, high speed vehicle operation in a closed fresh water pool was initiated with a full battery charge at 13.4 volts.

TABLE I

| Time | Voltage | AMP Draw |
|---|---|---|
| 10 min. | 11.8 | 30 |
| 15 min. | 11.7 | 30 |
| 20 min. | 11.6 | 30 |
| 25 min. | 11.4 | 30 |
| 30 min. | 11.2 | 30 |
| 35 min | 10.9 | 30 |
| 40 min. | 10.6 | 29 |
| 45 min. | 10.0 | 27 |
| 50 min. | 8.2 | 23 |
| 55 min. | 6.4 | 17 |
| 60 min. | 5.4 | 13 |

Having fully disclosed our invention, those of ordinary skill in the art will recognize obvious equivalencies and alternatives. As our invention, however,

We claim:

1. An aquatic vehicle having body means with a plurality of partitioned compartments, propulsion means for thrusting said body means through a body of water, electric motor means for driving said propulsion means, storage battery means for energizing said motor means and switching means for controlling energy flow from said battery means to said motor means, said switching means including water responsive control means for interrupting energy flow from said battery means to said motor means unless sensor elements respective to paid water responsive control means are water wetted, and light emitting diode means connected with said battery means whereby a qualitative state of battery charge is reported by selected illumination patterns of said diode means.

2. An aquatic vehicle as described by claim 1 comprising a plurality of light emitting diodes, said diodes connected in circuit with said battery means whereby all of said plurality are illuminated when said battery means is fully charged.

3. An aquatic vehicle as described by claim 2 wherein none of said diodes emit light when said battery means is discharged.

4. An aquatic vehicle having body means for enclosing functional components, propulsion means for thrusting said body means through a mass of water, electric motor means for driving said propulsion means, storage battery means for energizing said motor means and switching means for controlling energy flow from said battery means to said motor means, said body means including an elongated, substantially cylindrical tube wall having a fore end and an aft end, a plurality of directional stabilizing fin means secured to said tube wall at said fore and aft ends, respectively, and radiating therefrom and handle bar means secured to said tube wall between said fore and aft end fin means for providing a user a hand gripping appliance, said aft fin means including a substantially circular shroud of greater circumference than said body tube cylinder surrounding said propulsion means and secured to said aft fin means.

5. An aquatic vehicle as described by claim 4 wherein said body means includes a nose piece that is detachable from said tube wall fore end, said nose piece having an externally open compartment and accessory attaching means within said open compartment.

6. An aquatic vehicle as described by claim 5 wherein said open compartment is adapted to receive a source of portable illumination.

7. An aquatic vehicle as described by claim 5 wherein said vehicle is constructed and balanced to obtain a slight positive buoyancy.

8. An aquatic vehicle as described by claim 7 wherein said open compartment is adapted to receive sufficient ballast to weigh said vehicle to a slight negative buoyancy.

9. An aquatic vehicle as described by claim 8 wherein said ballast is a source of illumination.

10. An aquatic vehicle having elongated body means, propulsion means for thrusting said body means through a body of water, electric motor means for driving said propulsion means, storage battery means for energizing said motor means and switching means for controlling energy flow from said battery means to said motor means, said battery means having a plurality of fluid tight cells including therewithin an immobilized, thixotropic electrolyte, said electrolyte having a network of paths therein to channel gas generated from said electrolyte by a first polar battery plate to a second polar battery plate.

11. An aquatic vehicle as described by claim 10 wherein said electrolyte comprises an excess of $H_2SO_4$ for a discharge reaction with available PbO whereby the formation of $H_2O$ is restricted.

12. An aquatic vehicle as described by claim 11 having greater negative plate capacity than positive plate capacity.

13. An aquatic vehicle having body means with a plurality of partitioned compartments, propulsion means for thrusting said body means through a body of water, electric motor means for driving said propulsion means, storage battery means for energizing said motor means and switching means for controlling energy flow from said battery means to said motor means, said battery means having a plurality of fluid tightly sealed, lead/acid cells having a thixotropically immobilized gelatinous electrolyte.

14. An aquatic vehicle as described by claim 13 wherein said electrolyte comprises an excess of $H_2SO_4$ for a discharge reaction with available PbO whereby the formation of $H_2O$ is restricted.

15. An aquatic vehicle as described by claim 14 having positive and negative plates within said cells whereby negative plate capacity exceeds positive plate capacity.

16. An aquatic vehicle having body means for enclosing functional components, propulsion means for thrusting said body means through a mass of water, electric motor means for driving said propulsion means, storage battery means for energizing said motor means and switching means for controlling energy flow from said battery means to said motor means, said body means including an elongated, substantially cylindrical tube wall having an aft end surrounding said motor means and an annular flow space between said motor means and said tube wall, aperture means through said tube wall aft end to pass a flow of water therethrough into cooling contact with motor housing means and into said propulsion means, said tube wall aperture means being positioned between aft fin means projecting radially from said tube wall aft end, and, propeller shrouding duct means secured to said aft fin means to structurally rigidify said aft fin means and collimate induction flow outside of said tube wall into said propulsion means.

17. An aquatic vehicle as described by claim 16 having handle means secured to said tube wall ahead of said aft fin means and aft of a vehicle mid-length plane and canard fins secured to said tube wall ahead of said mid-length plane.

18. An aquatic vehicle as described by claim 17 wherein said body means includes a detachable nose piece having an externally open compartment.

19. An aquatic vehicle as described by claim 18 wherein said vehicle is constructed and balanced to obtain a slight positive buoyancy.

20. An aquatic vehicle as described by claim 19 wherein said open compartment is adapted to receive sufficient ballast to weigh said vehicle to a slight negative buoyancy.

21. An aquatic vehicle as described by claim 20 wherein said ballast is a source of illumination.

22. An aquatic vehicle as described by claim 17 wherein said switching means is integrated into said handle means.

23. An aquatic vehicle as described by claim 22 wherein said switching means comprises a manual switch integrated into each of two handles of said handle means, each said switch respectively controlling a predetermined motor means running speed.

24. An aquatic vehicle as described by claim 17 having light emitting diode means secured to said tube wall in the proximity of said mid-length plane for visibility from a vantage external of said body means, said light emitting diode means being connected with said battery means to report the state of battery charge.

25. An aquatic vehicle having an elongated body propelled by an electric motor driven propulsion means, said electric motor being energized by a wet cell storage battery, a control circuit for regulating energy flow from said battery to said motor, said control circuit including a manual switch circuit for selective motor operation and liquid sensor means for disabling said manual switch circuit when said vehicle is not buoyantly supported.

26. An aquatic vehicle as described by claim 25 wherein said liquid sensor means comprises a pair of charged electrodes on the surface of said body at a normally wetted location when said vehicle is buoyantly supported.

27. An aquatic vehicle as described by claim 26 wherein said liquid sensor means completes a circuit continuity with said storage battery when a current flow between said electrodes is detected.

* * * * *